US006349423B1

(12) United States Patent
Kelleher

(10) Patent No.: US 6,349,423 B1
(45) Date of Patent: Feb. 26, 2002

(54) TOILET GRAB RAIL SUPPORT

(76) Inventor: Helen Joy Kelleher, 70 MacGregor Street, Deakin ACT 2600 (AU)

( * ) Notice: Subject to any disclaimer, the term of this patent is extended or adjusted under 35 U.S.C. 154(b) by 0 days.

(21) Appl. No.: 09/555,277

(22) PCT Filed: Nov. 27, 1998

(86) PCT No.: PCT/AU98/00979

§ 371 Date: May 26, 2000

§ 102(e) Date: May 26, 2000

(87) PCT Pub. No.: WO00/32081

PCT Pub. Date: Jun. 8, 2000

(30) Foreign Application Priority Data

Nov. 27, 1997 (AU) ..... PP0630

(51) Int. Cl.[7] ..... E03D 11/00
(52) U.S. Cl. ..... 4/254; 4/667; D23/309
(58) Field of Search ..... 4/254, 478, 667; 297/411.23, 411.24, DIG. 10; D23/309

(56) References Cited

U.S. PATENT DOCUMENTS

| | | | | | |
|---|---|---|---|---|---|
| D179,394 | S | * | 12/1956 | Mills | D23/309 |
| 3,047,884 | A | * | 8/1962 | Grondona | 4/254 |
| 3,323,144 | A | * | 6/1967 | Ferris, Jr. | 4/254 |
| 3,405,411 | A | | 10/1968 | Brown | 4/254 |
| 3,574,242 | A | | 4/1971 | Trowbridge | 4/254 |
| 3,969,778 | A | * | 7/1976 | Richards | 4/254 |
| 4,924,531 | A | * | 5/1990 | Square | 297/DIG. 10 |

FOREIGN PATENT DOCUMENTS

| | | | | |
|---|---|---|---|---|
| AU | 48277/97 | | 6/1998 | |
| DE | 3622853 | A | 1/1987 | |
| EP | 777994 | A | 6/1997 | |
| FR | 1208432 | | 6/1958 | |
| FR | 2596-265 | A * | 10/1987 | 4/254 |
| FR | 2627372 | | 8/1989 | |
| GB | 2177130 | A | 1/1987 | |
| WO | WO 90 05477 | A | 5/1990 | |
| WO | WO 92 14388 | | 9/1992 | |
| WO | WO 95 27430 | A | 10/1995 | |

* cited by examiner

*Primary Examiner*—Gregory L. Huson
*Assistant Examiner*—Tuan Nguyen
(74) *Attorney, Agent, or Firm*—Pitney, Hardin, Kipp & Szuch LLP

(57) ABSTRACT

A toilet bowl (2) having a seat (7) held by bolts passing through a rear portion (4) of toilet bowl (2) is provided with a grab rail support comprising a mounting portion (3) secured by the bolts and side rails (8) rigidly connected to mounting portion (3) and extending forwardly close to the outer surface of the toilet bowl (2). Near the front of the toilet bowl (2), side rails (8) curve upwardly and are configured to form rigid hand pieces which can be gripped by persons lowering themselves onto and raising themselves from the toilet seat.

6 Claims, 1 Drawing Sheet

TOILET GRAB RAIL SUPPORT

BACKGROUND OF THE INVENTION

This invention relates to a safety device which may be used to assist persons positioning themselves in a water closet of the type having a toilet bowl in which human body wastes are flushed down a drain by water from a cistern or the like. In water closets of this type, the toilet bowl is supported on the floor or from a wall and is usually provided with a toilet seat which has two pivotally connected portions, viz. a fixed portion mounted on the upper rim of the toilet bowl and a movable portion which may be pivoted from a generally horizontal or seating position to an upright or urinal position.

It is proposed to provide a safety device in the form of a grab rail which can be rigidly mounted on a toilet bowl to make it easier and safer for persons to lower themselves onto and raise themselves from a toilet seat. Although the toilet grab rail may be used by anybody, it is particularly suitable for the ages, the disabled, the incapacitated and other handicapped persons who are at risk or face difficulties when attempting to use this type of toilet facility.

DESCRIPTION OF THE PRIOR ART

Various aids have been proposed to assist handicapped people to use toilet facilities unaided and without needing the attendance of a carer. In one proposal, grab rails have been fixed to the walls of a water closet. These have not proved to be a satisfactory solution for handicapped people. In large water closets, these grab rails are often too remote for convenient and safe use by all handicapped people. In smaller water closets, grab rails sometimes hinder the movement of a handicapped person in the water closet.

Some prior devices have been supported by the floor and thus occupy valuable floor space to the inconvenience of handicapped persons. Some devices are not fixed to the floor and they pose a serious risk to unaided handicapped users. It has also been proposed to support armrests from mounts on the toilet seat and also from mounts on the toilet bowl. The purpose of the armrests is merely to enable an occupant to maintain a more comfortable and helpful posture. The prior armrests have not been designed to support the weight of a person lowering himself onto the toilet seat or getting up therefrom.

It has also been proposed to provide a toilet seat with supporting handles, either moulded as part of the seat or supported by the seat. These supporting handles are of no assistance when the toilet seat is in an upright position. It is often a difficult and risky task for a handicapped person to attempt to move a toilet seat from an upright to a horizontal position. Furthermore, when the supporting handles are under load, there is a risk that the toilet seat will break where the handles join the seat. Further, the supporting handles have caused problems when attempting to clean and sanitise the toilet seat.

Another prior proposal provides a structure supported by the toilet bowl having a pair of pivotally mounted rails on which the arms may be supported. The rails may be moved from an upright inoperative position at the rear of the toilet bowl to an operative inclined position directed towards the front of the toilet bowl. These moving rails put an unaided handicapped person at risk when attempting to move them to the desired position, particularly when the rails move unexpectedly or not in the desired direction of movement.

DESCRIPTION OF THE INVENTION

It is an object of the invention to provide a toilet grab rail support which may be rigidly mounted on a toilet bowl and is formed so as to assist handicapped persons lowering themselves onto a toilet seat and raising themselves therefrom.

Accordingly, the invention provides a toilet grab rail support for a toilet bowl having a seat held thereon by bolts passing through a fixed portion of the seat and through the toilet bowl, said grab rail support comprises a mounting portion adapted to be rigidly mounted on the rear portion of the toilet bowl and secured thereto by said bolts, side rails rigidly connected to the mounting portion so that, when the device is mounted on the toilet bowl, the side rails extend forwardly from the mounting portion so as to be spaced closely from the outer surface of the toilet bowl near the rim thereof, the side rails near the front of the toilet bowl curve upwardly and are configured to form rigid hand pieces which can be gripped by persons lowering themselves onto and raising themselves from the toilet seat.

BRIEF DESCRIPTION OF THE DRAWINGS

The invention will now be described in relation to the accompanying drawings in which.

DESCRIPTION OF THE EMBODIMENTS

Figure 1:
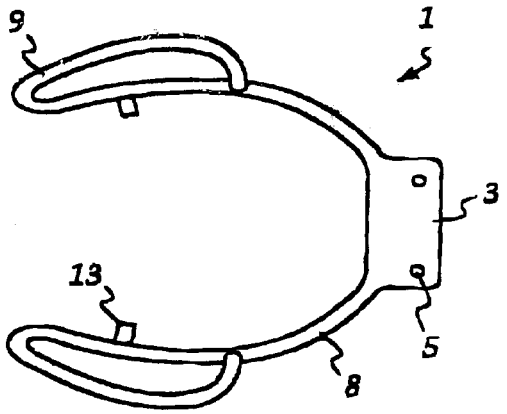
FIG. 1 is a plan view of a toilet grab rail support according to one embodiment of the invention.
Figure 2:
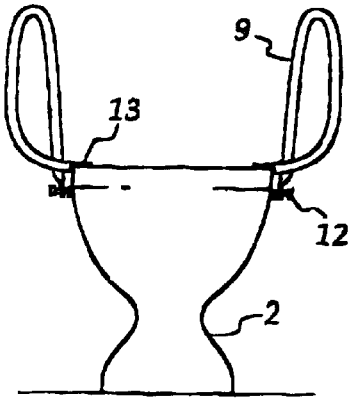
FIG. 2 is a front elevation of the toilet grab rail support of FIG. 1 mounted on a toilet bowl.
Figure 3:
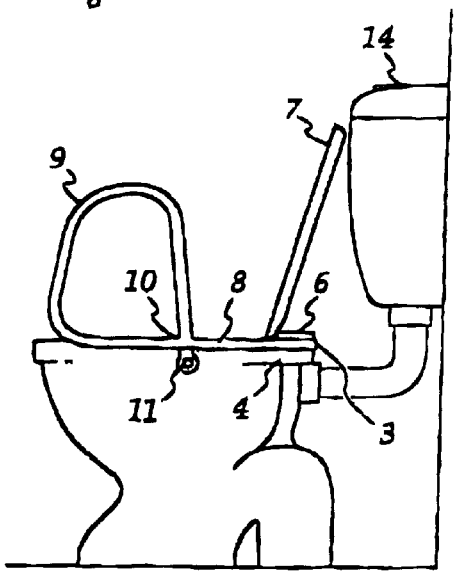
FIG. 3 is a side elevation of FIG. 2 including additional components of the toilet facility.

FIGS. 1, 2 and 3 illustrate a toilet grab rail support according to one embodiment of the invention. In its fitted position as illustrated in FIGS. 2 and 3, the toilet grab rail support 1 is fixedly mounted on toilet bowl 2 adjacent to the upper rim thereof.

Toilet grab rail support 1 comprises a base or mounting portion 3 which, in its fitted position, rests on the rear portion 4 of the upper rim of toilet bowl 2. Mounting portion 3 is provided with two vertical (when in position on toilet bowl 2) holes 5 therethrough for receiving the bolts (not shown) which are normally used to hold the fixed portion 6 of toilet seat 7 on the rear portion 4 of the upper rim of the toilet bowl 2. When assembled in position, the bolts are tightened so that mounting portion 3 is rigidly held between rear portion 4 and fixed portion 6. For adjustment purposes, more than one pair of holes 5 may be provided.

Rigidly connected to mounting portion 3, and projecting forwardly therefrom, are two curved side rails 8 which, when the toilet grab rail support 1 is mounted on the toilet bowl 2, are closely spaced from the outer surface of the curved sides of toilet bowl 2 adjacent the rim thereof. Alternatively, side rails 8 may be formed integrally with mounting portion 3. The forward portion of each side rail 8 is curved back upon itself to form an upwardly and rearwardly extending loop 9 and a part near to the end of side rail 8 is rigidly joined to an intermediate part at 10. The downwardly extending end portion 11 forms a support for rubber capped bolts 12 which may be adjusted to press firmly against the outer surface of toilet bowl 2. Joined to side rails 8 are lugs 13 which rest upon the upper surface of the rim of toilet bowl 2 near the front thereof. Loops 9 are sufficiently spaced so as not to impede the pivoting movement of seat 7 from a horizontal position to an upright position resting against cistern 14.

It is important that toilet grab rail support 1 when mounted in position on toilet bowl 2 presents a strong stable construction. Toilet grab rail support 1 may be made of metal such as stainless steel. Lugs 13 are rigidly connected to side arms 8 as by welding. Joint 10 is also rigid connection as by welding. As a preferred alternative, toilet grab rail support 1 may be powder coated in a colour to match or compliment toilet bowl 2 or the walls or other fittings of the water closet.

The toilet grab rail support 1 is compact and fits snugly on toilet bowl 2 with its mounting portion 3 securely supported between the rear portion 4 of the toilet bowl and the fixed portion 6 of the seat and with side rails 8 closely spaced from the outer surface of toilet bowl 2. It may be easily assembled on the commonly used toilet bowl 2. When mounted in position, it provides a stable rigid construction with, no moving parts which is very safe enabling a handicapped person to sit down on and get up from a toilet seat unaided. Toilet grab rail support 1 does not interfere with any wall or floor space and does not encroach on the opening of toilet bowl 2. Further, it does not impede movement of the toilet seat 7. If the toilet seat 7 is in an upright position, it offers a stable support to a handicapped person while he moves the toilet seat 7 to a horizontal position.

The loop portion 9 forms a convenient hand piece which may be gripped anywhere along its length. In particular, the two spaced substantially horizontal portions of loop 9 provide in effect two spaced grab rails to assist a handicapped person moving onto or getting up from a toilet seat. For example, the lower grab rail adjacent the toilet seat may be used to assist initial movement off the toilet seat and the upper grab rail may be used to assist movement to a standing position. In addition, loop 9 may be gripped to steady a man standing to urinate into toilet bowl 2.

Figure 4:
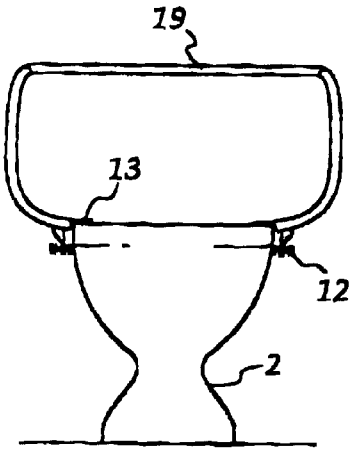
FIGS. 4 and 5 are views similar to FIGS. 2 and 3 illustrating a second embodiment of the invention.
Figure 5:
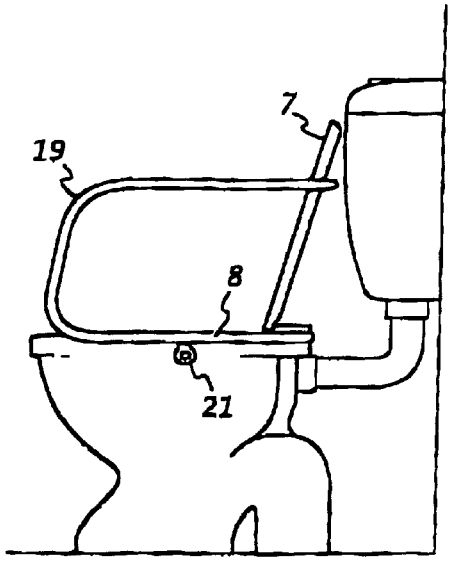

In the embodiment illustrated in FIGS. 4 and 5, upper grab rail 19 is formed from one continuous length of rail. Side rails 8 adjacent the toilet seat are of similar construction to those in the first embodiment and serve as lower grab rails. Near the front of toilet bowl 2, a side rail 8 curves upwardly, then rearwardly, then transversely to the other side of toilet bowl 2 where it is similarly configured. Supporting members 21 are welded to side rails 8 to support adjustable bolts 12.

In other embodiments of the invention, the side rails 8 adjacent to the toilet seat may be of similar construction to those described above and would serve as the lower grab rails. However, the remaining portion including the upper grab rails may be designed to meet the special needs of a particular user. If desired, parts of the side rail may be interchangeable to cater for several users, but it is important that an interchanged part is locked securely in position therefor the grab rail support is used by a handicapped person. In another embodiment that is specially adapted for a wheel chair patient, part of the grab rail support may be removable or formed of a pivoted construction. In either case, effective locking of the removable or pivoted portions is essential before the weight of a wheelchair patient is applied to the grab rail support.

The claims defining the invention are as follows:

1. A toilet grab rail support for a toilet bowl having a seat held thereon by bolts passing through a fixed portion of the seat and through the toilet bowl, said grab rail support comprising a mounting portion adapted to be rigidly mounted on the rear portion of the toilet bowl and secured thereto by said bolts, side rails rigidly connected to the mounting portion so that, when the grab rail support is mounted on the toilet bowl, the side rails extend forwardly from the mounting portion so as to be spaced closely from the outer surface of the toilet bowl near the rim thereof, the side rails near the front of the toilet bowl are curved upwardly then curved rearwardly and downwardly in the form of a loop and are configured to form rigid hand pieces which can be gripped by persons lowering themselves onto and raising themselves from the toilet seat, each of said side rails further being provided with a lug adapted to rest on the upper rim of the toilet bowl so as to support said grab rail support thereto without touching the floor of a bathroom.

2. The toilet grab rail support as claimed in claim 1, characterized in that each side rail is configured to form two substantially horizontal and vertically spaced grab rails.

3. The toilet grab rail support as claimed in claim 2, characterized in that the lower of the two grab rails is disposed adjacent the toilet seat.

4. The toilet grab rail support as claimed in claim 1, characterized in that downwardly extending members fixed to the side rails support adjustable rubber capped bolts which press against the outer surface of the toilet bowl.

5. The toilet grab rail support as claimed in claim 1, characterized in that the support is made of powder coated metal.

6. A toilet grab rail support for a toilet bowl having a seat held thereon by bolts passing through a fixed portion of the seat and through the toilet bowl, said grab rail support comprising a mounting portion adapted to be rigidly mounted on the rear portion of the toilet bowl and secured thereto by said bolts, side rails rigidly connected to the mounting portion so that, when the grab rail support is mounted on the toilet bowl, the side rails extended forwardly from the mounting portion so as to be spaced closely from the outer surface of the toilet bowl near the rim thereof, the side rails are formed from one continuous rail which passes transversely across the toilet bowl adjacent the rear thereof, the side rails near the front of the toilet bowl are curved upwardly and are configured to form rigid hand pieces which can be gripped by persons lowering themselves onto and raising themselves from the toilet seat, each of said side rails further being provided with a lug adapted to rest on the upper rim of the toilet bowl so as to support said grab rail support thereto without touching the floor of a bathroom.

* * * * *